US006992539B1

(12) United States Patent
How

(10) Patent No.: US 6,992,539 B1
(45) Date of Patent: Jan. 31, 2006

(54) METHOD AND APPARATUS OF OBTAINING BALANCED PHASE SHIFT

(76) Inventor: Hoton How, 262 Clifton St., Belmont, MA (US) 02478

( * ) Notice: Subject to any disclaimer, the term of this patent is extended or adjusted under 35 U.S.C. 154(b) by 62 days.

(21) Appl. No.: 10/807,476

(22) Filed: Mar. 24, 2004

(51) Int. Cl.
*H01P 1/19* (2006.01)

(52) U.S. Cl. ..... 333/24.1; 333/161; 333/219.2

(58) Field of Classification Search ..... 333/24.1, 333/158, 161, 219.2, 205
See application file for complete search history.

(56) References Cited

U.S. PATENT DOCUMENTS 6,483,393 B1 * 11/2002 How ..... 333/24.1

* cited by examiner

*Primary Examiner*—Stephen E. Jones

(57) ABSTRACT

Disclosed is a method and an apparatus enabling operation of balanced phase shifts providing uniformity that the insertion loss do not show variation with the derived angles in phase shift. The invention incorporates a resonator supporting nonreciprocal wave propagation. The resonator is divided in two equal parts showing symmetry so that the change in electronic parameters from one part of the resonator counter balances the other part, thereby causing no change to the resonance condition. Amplifiers are thus not needed by the phase-shift operation. Electronically active materials, such as ferrites, ferroelectrics, and/or varactors, are utilized, and the phase shifter device can be fabricated assuming a variety of transmission-line geometries, such as microstrips, striplines, waveguides, coax lines, parallel wires, coplanar waveguides, image lines, fin lines, and slot lines, providing versatility and convenience in applications.

8 Claims, 9 Drawing Sheets

Prior Art $$\Delta\theta = 2n\,\Delta L/\lambda$$

$$\Delta\theta = 2n\,\Delta L/\lambda$$

Side View

Top View

METHOD AND APPARATUS OF OBTAINING BALANCED PHASE SHIFT

FEDERALLY SPONSORED RESEARCH (Not Applicable)

SEQUENCE LISTING OR PROGRAM (Not Applicable)

BACKGROUND

1. Field of Invention

Figure 1:
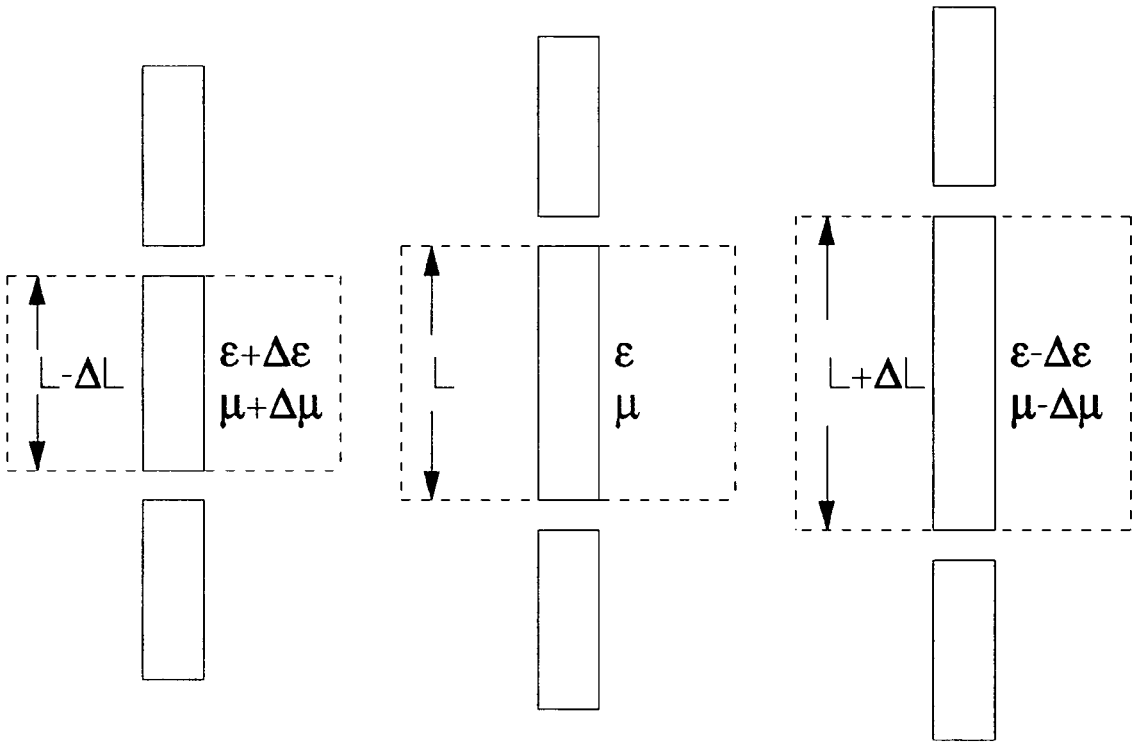

This invention is directed to a method and an apparatus to obtain balanced phase shift from a resonator supporting nonreciprocal wave propagation. As such, uniform phase shift results whose amplitude shows insignificant dependence on the derived angle in phase shift thereby eliminating the need for an amplifier.

2. Prior Art

Microwave and millimeter-wave (MMW) devices and systems are becoming increasingly important today for both defense and commercial applications. For example, in the collision avoidance industries, low-profile antennas are needed providing electronically steerable radiations to detect and identify obstacles and protrusions in front of a moving vehicle. Upon navigation the receiver antennas need to follow and track the motion of GPS (Global Positioning Systems) satellites so as to continuously monitor and update their positions. Also, there is a need to create radiation nulls along certain spatial directions for an antenna transmitter/receiver to warrant secure and covert communications. Other applications can be found in target searching/tracking radars, satellite communication systems, and TV program broadcasting antennas installed with a civilian jet carrier.

In a phased array system it is possible to include frequency-agile materials (varactors, ferroelectrics, and ferrites) together with amplifiers to tune and adjust the phase and amplitude of each individual element so as to compose and tailor the overall radiation into a desirable pattern. However, beam forming in this manner is costly; depending on the speed, frequency, and angle of steering, each phase-shifting element can cost as much as $10 0~1,000, and in a system containing 10,000 elements, the cost of the antenna array system becomes formidable. Power dissipation is another consideration, since amplifiers are used following each of the phase shifting processes to compensate signal propagation loss, or insertion loss. To avoid overheating, water cooling is, therefore, often applied in a large phased array system.

A radiation beam can also be steered via mechanical means, as commonly observed for a traffic radar installed at the airports. However, steering in this manner is slow, suffering from potential mechanical breakdowns. To incorporate free rotation, the antenna take up considerable space and the shape of the antenna is not conformal. As such, it is unlikely to apply a mechanically rotating radar in a body moving at high speed.

Collision avoidance radars are popular these days installed with automotive ground vehicles and with airline jets. However, the current collision avoidance radars perform only the basic functions for target detection; these radars are not able to recognize a target, and hence they do not have the intelligence to handle targets of different kinds. In order to give the radar such intelligence, a steering radar is needed, performing image reconstruction based upon information collected from a steering beam. This requires an array of radiators whose phases can be controlled with accuracy in an economic manner. The prior art is not able to accomplish this purpose.

Conventionally, a phase shifter is obtained by incorporating a transmission line whose electric length, or electric permittivity and/or magnetic permeability, can be varied by applying a voltage, a current, or a bias magnetic field, as explained in FIG. 1 below. However, to obtain a large angle in phase shift a long line is needed, which translates into high cost and large volume. Also, insertion loss can be a serious problem if the phase shifter demands a long transmission line to operate. Otherwise, significant return loss will result, if the electric property of the transmission line has been changed appreciably due to the resultant change in line impedance. Even worse, in applications for a large phased array a large number of phase shifters is required, and there are problems such as how to integrate the phase shifters with the array system providing compatibility and uniformity with economy and size fit.

OBJECTS AND ADVANTAGES

Accordingly, it is an objective of the invention to address one or more of the foregoing disadvantages or drawbacks of the prior art, and to provide such improved method and apparatus to obtain phase shift, permitting fast response with economy and reduced size, providing compatibility and uniformity when integrated with a large phased array system without requiring the use of amplifiers for signal propagation-loss compensation.

Other objects will be apparent to one of ordinary skill, in light of the following disclosure, including the claims.

SUMMARY

In one aspect, the invention provides a method to achieve balanced phase shift in a resonator supporting nonreciprocal wave propagation. The resonator is divided into two equal parts showing symmetry which counter balance each other against the changes made with the resonator. Namely, upon the intended phase-shift operation the electronic parameters of the respective parts of the circuit is made to change counter reactively but to retain the whole circuit parameters unchanged to the first-order approximation. This results in phase shifts with constant insertion loss, to be valid to the first-order approximation. As such, there is no need to use an amplifier to compensate for the non-constant insertion loss, as implied by the prior art.

In another aspect the invention provides an apparatus which contains a nonreciprocal resonator with two counter balanced parts. By changing the electronic parameters of the resonator in a balanced manner, phase shifts result, but to retain the insertion loss unchanged, to be valid to the first-order approximation. The electronic parameters of the two counter parts of the resonator are changed either electrically, magnetically, or both, giving rise to convenience in operation. The apparatus can be fabricated in the planar form to be compatible with the other planar-circuit geometries integrated with the receiver system. Or, the apparatus can be fabricated assuming the waveguide geometry so as to be used with the high-power transmitter applications.

DRAWINGS

Figures

For a more complete understanding of the nature and objectives of the present invention, reference is to be made to the following detailed description and accompanying drawings, which, though not to scale, illustrate the principles of the invention, and in which:

FIG. 1 shows the prior art that phase shifts are derived from a linear resonator supporting reciprocal wave propagation. The prior-art circuit is unbalanced and phase shifts thus obtained shows variations in insertion loss. As such, amplifiers are mandatorily used by the prior art to compensate for the non-uniform operation of the phase-shifter device.

Figure 2:
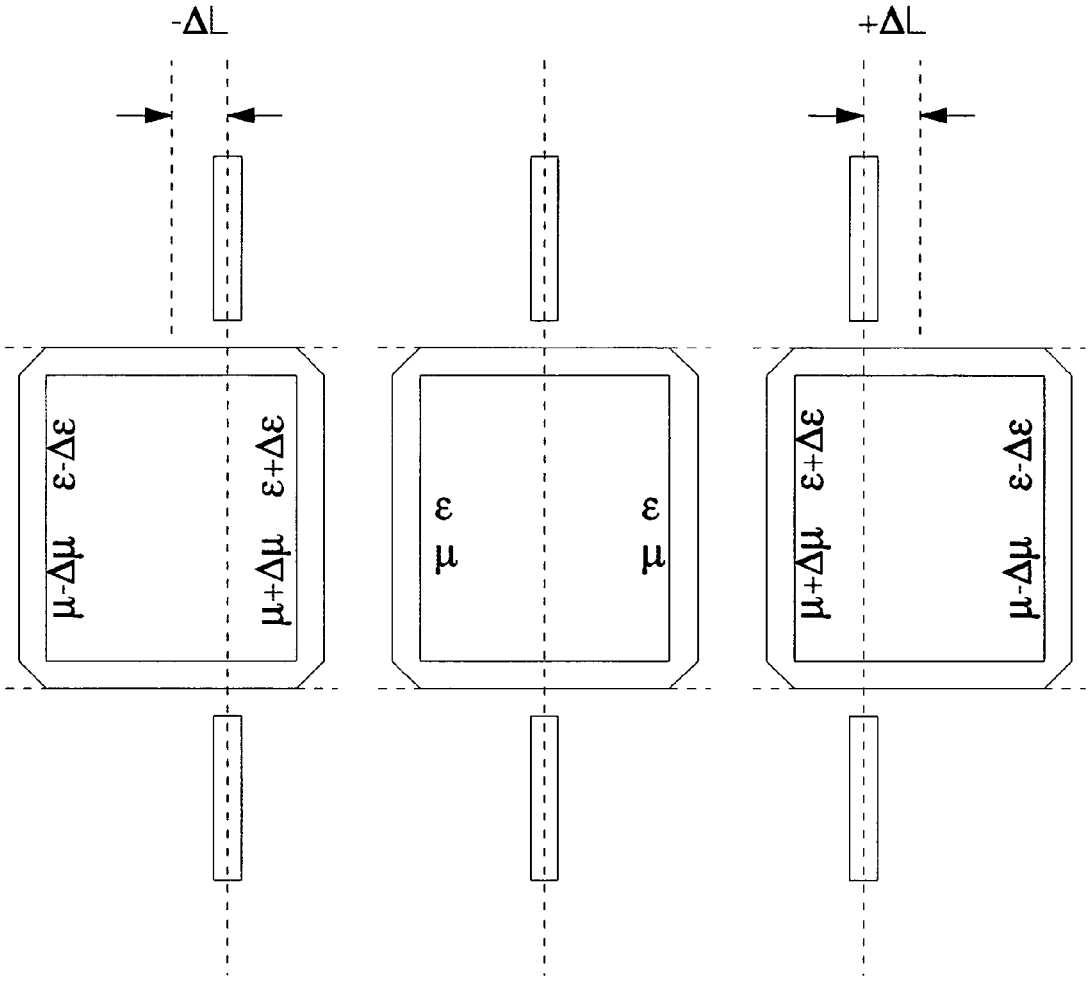

FIG. 2 explains how balanced phase shifts are obtained from a resonator supporting nonreciprocal wave propagation. The resonator is divided in two equal parts showing symmetry so that the change in electronic parameters in one part of the circuit counter-balances the other part, thereby warranting uniform operation of the phase-shifter device.

Figure 3:
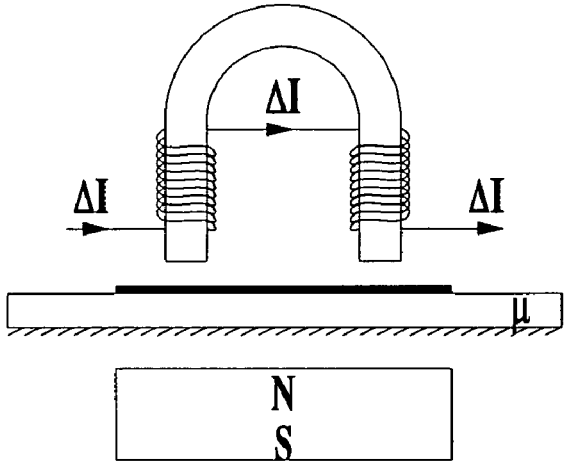
Figure 3:
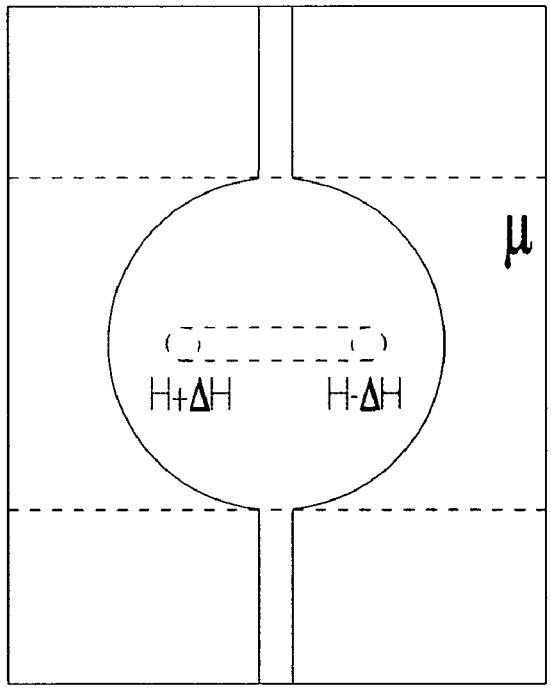

FIG. 3 shows one example of the preferred embodiment of the invention that a ferrite disk is biased by a magnetic field applied along the axial direction to stimulate nonreciprocity in wave propagation. By applying a pair of counter reacting magnetic fields onto the two sides of the resonator at symmetry balanced phase shift results, showing insignificant variation in insertion loss.

Figure 4:
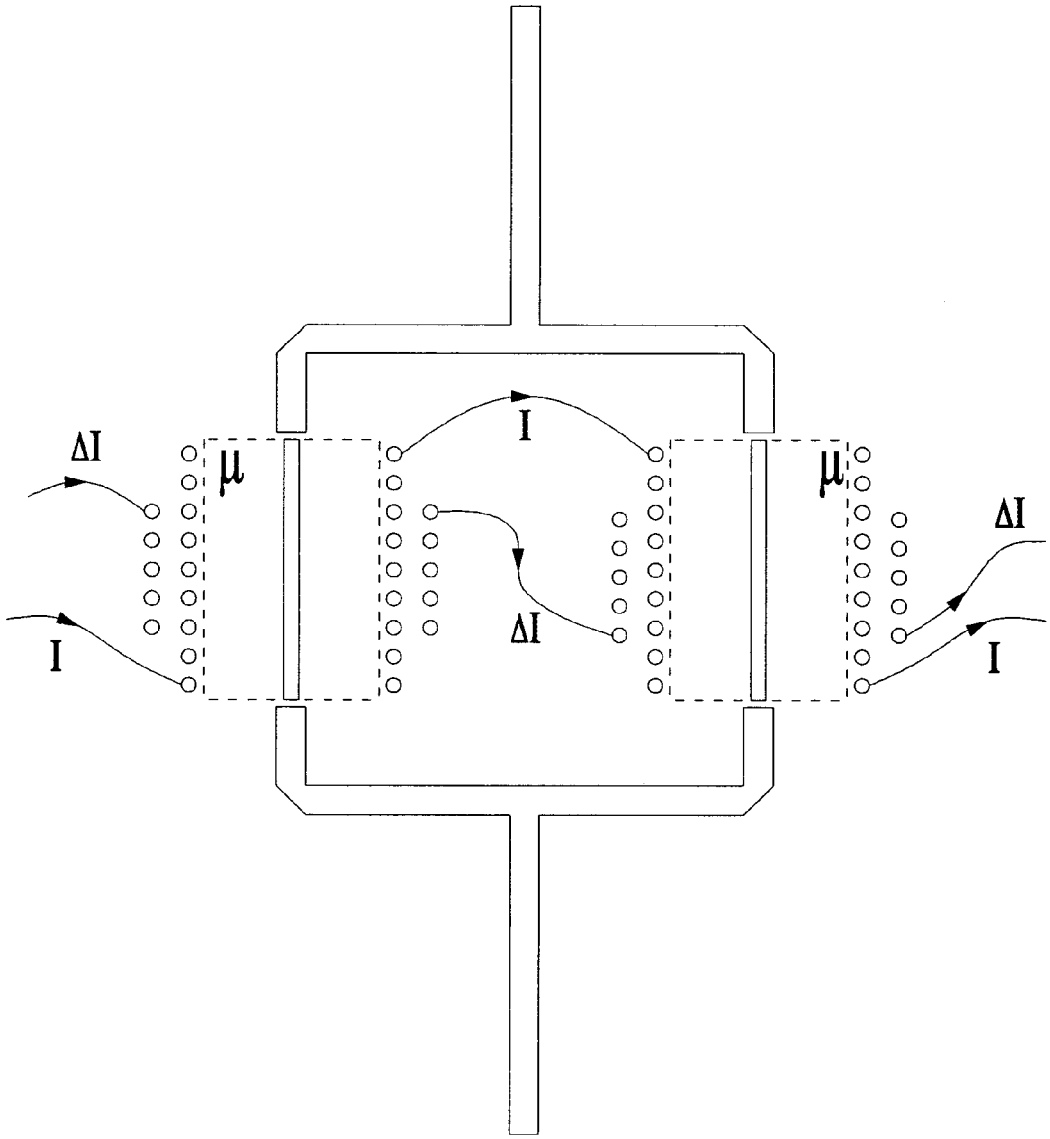

FIG. 4 shows one example of the preferred embodiment of the invention that a nonreciprocal resonator is constructed from a ring resonator loaded with ferrite materials showing symmetry. The ferrites are biased by the same common axial field so as to remove the degeneracy in wave propagation thereby attaining nonreciprocity. Balanced phase shifts result if a pair of secondary axial fields is applied counter-balancing each other, but showing insignificant variation in insertion loss.

Figure 5:
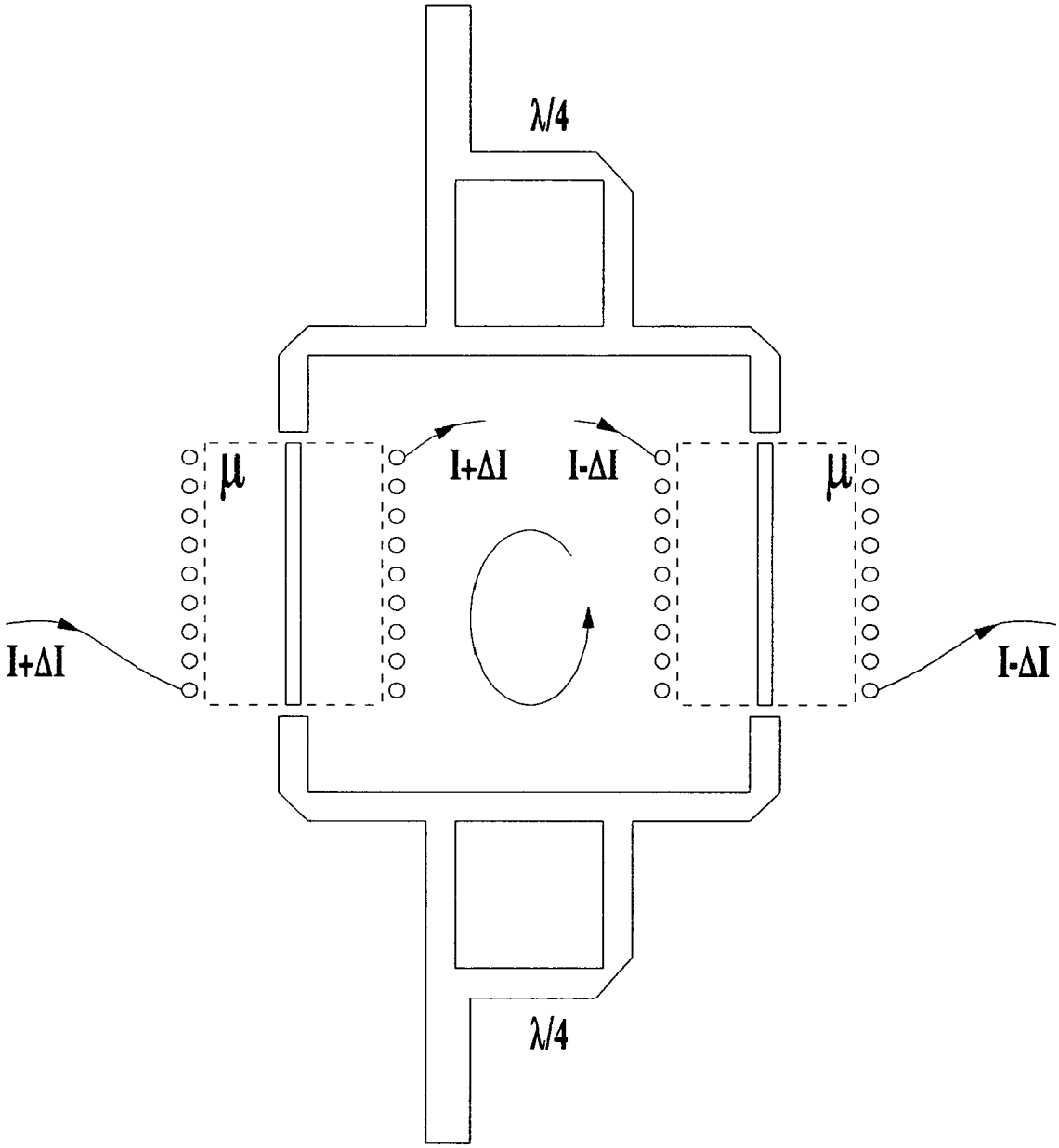

FIG. 5 shows one example of the preferred embodiment of the invention that the ferrites shown in FIG. 4 are biased by two primary coils combining the secondaries and the feeding structure has been changed to employ corporate in-phase feeders. This feeding structure can effectively suppress the other out-of-phase mode thereby reinforcing nonreciprocity in wave propagation. In comparison to FIG. 4 FIG. 5 is more appropriate for high-order resonance applications, or if unsaturated ferrites are used.

Figure 6:
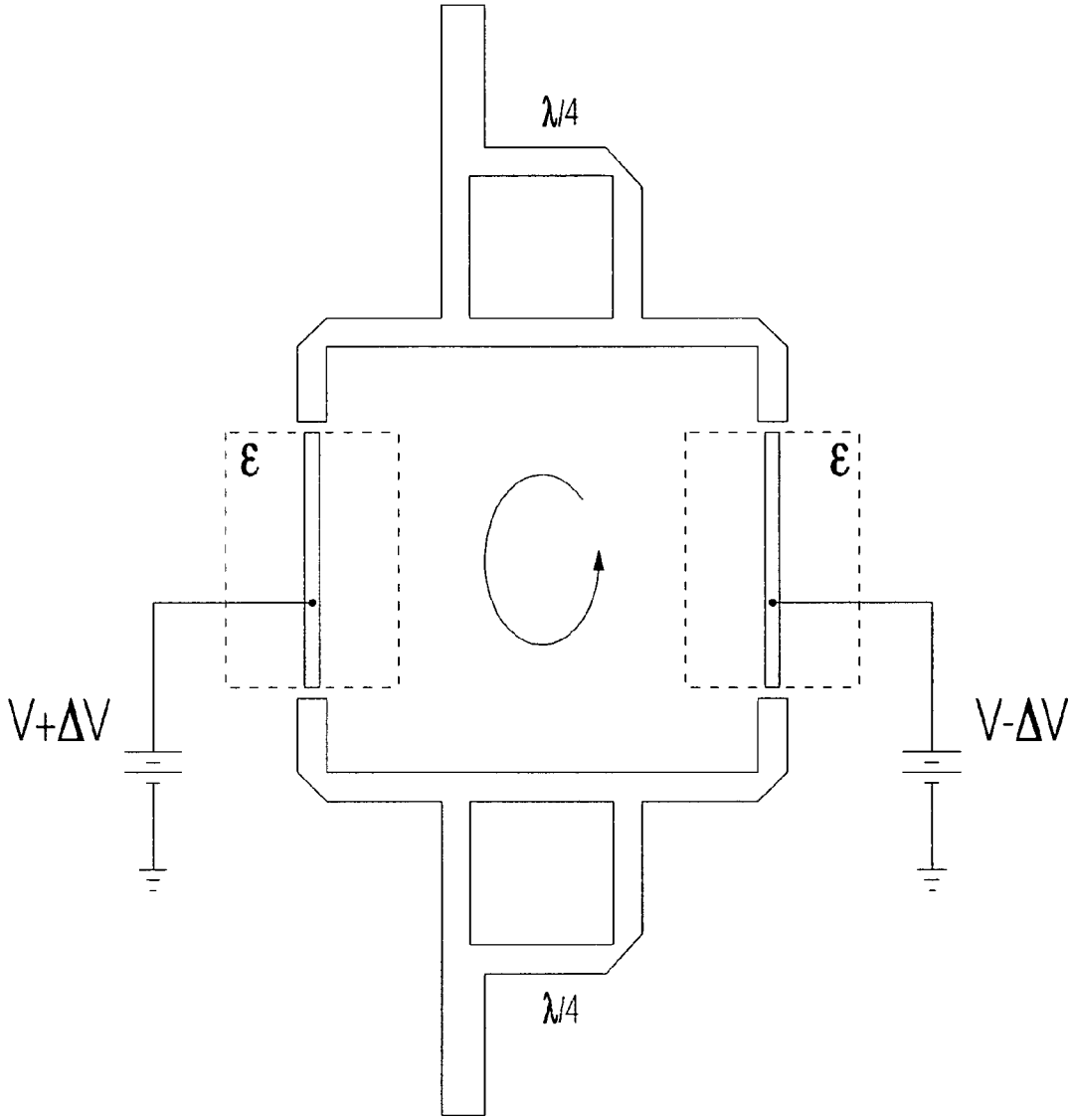

FIG. 6 shows one example of the preferred embodiment of the invention that a nonreciprocal resonator is constructed from a ring resonator loaded with ferroelectric materials showing symmetry, and the nonreciprocity stems from the employed corporate in-phase feeders, same as FIG. 5. By applying counter-reacting voltages onto the ferroelectric materials balanced phase shifts result, showing insignificant variation in insertion loss.

Figure 7:
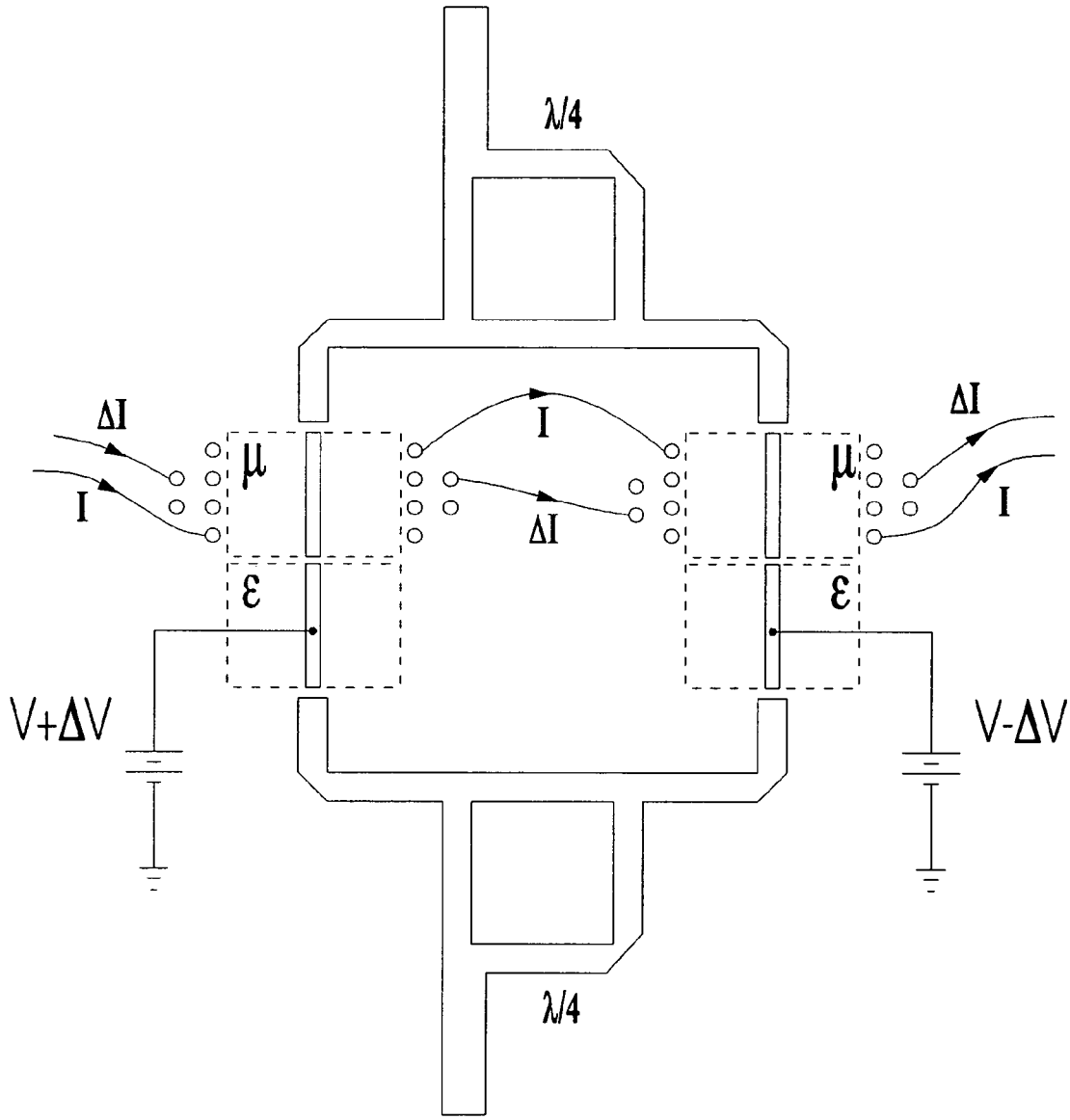

FIG. 7 shows one example of the preferred embodiment of the invention that a nonreciprocal resonator is constructed from a ring resonator loaded with both ferrite and ferroelectric materials showing symmetry, and the nonreciprocity stems from the employed corporate in-phase feeders, same as FIG. 5 and FIG. 6. By applying counter-reacting currents and voltages onto the respective ferrite and ferroelectric materials balanced phase shifts result, showing insignificant variation in insertion loss.

Figure 8:
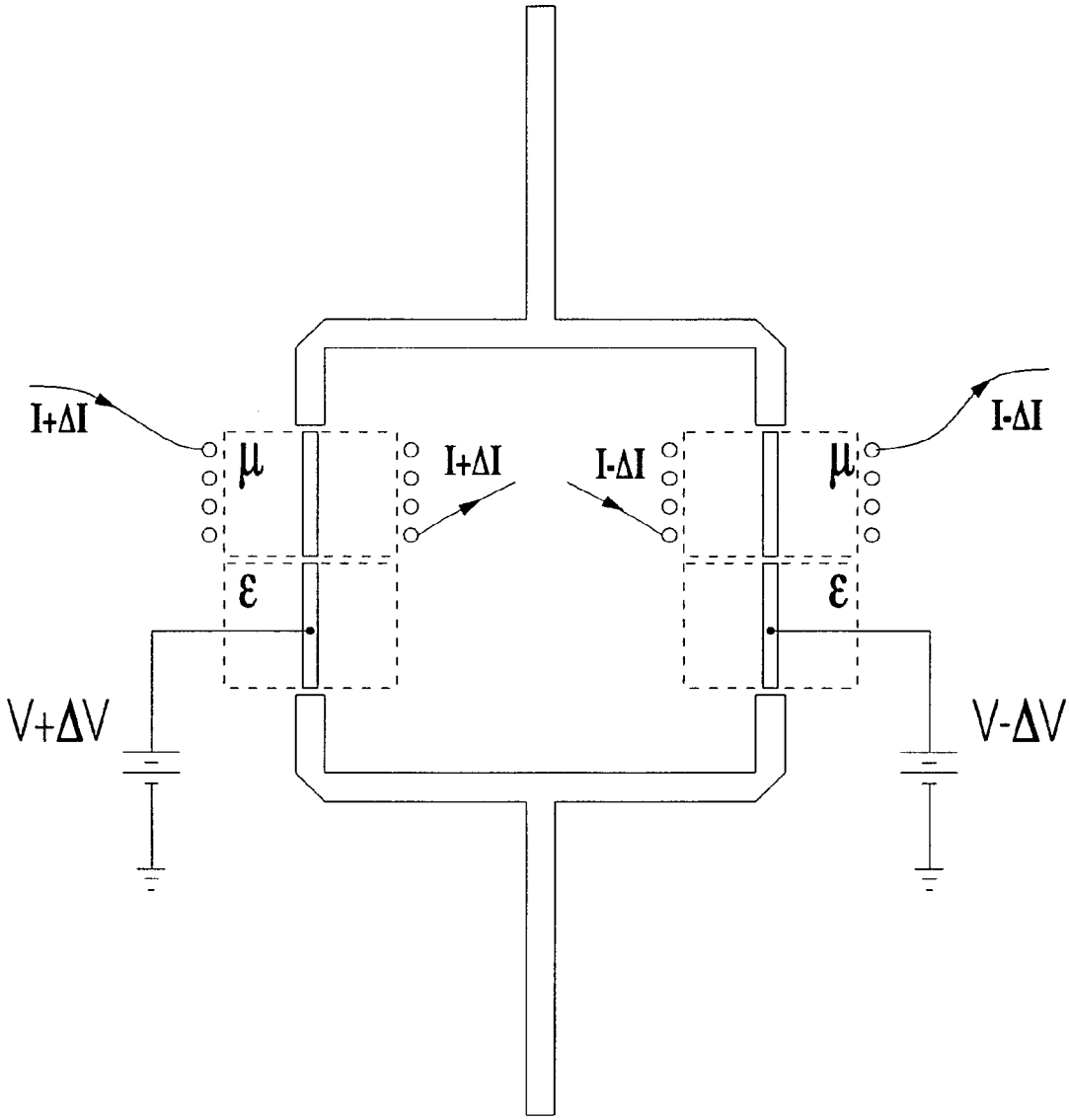

FIG. 8 shows one example of the preferred embodiment of the invention that a nonreciprocal resonator is constructed from a ring resonator loaded with both ferrite and ferroelectric materials showing symmetry, and the nonreciprocity stems from the ferrite materials, same as FIG. 4. By applying counter-reacting currents and voltages onto the respective ferrite and ferroelectric materials balanced phase shifts result, showing insignificant variation in insertion loss.

Figure 9:
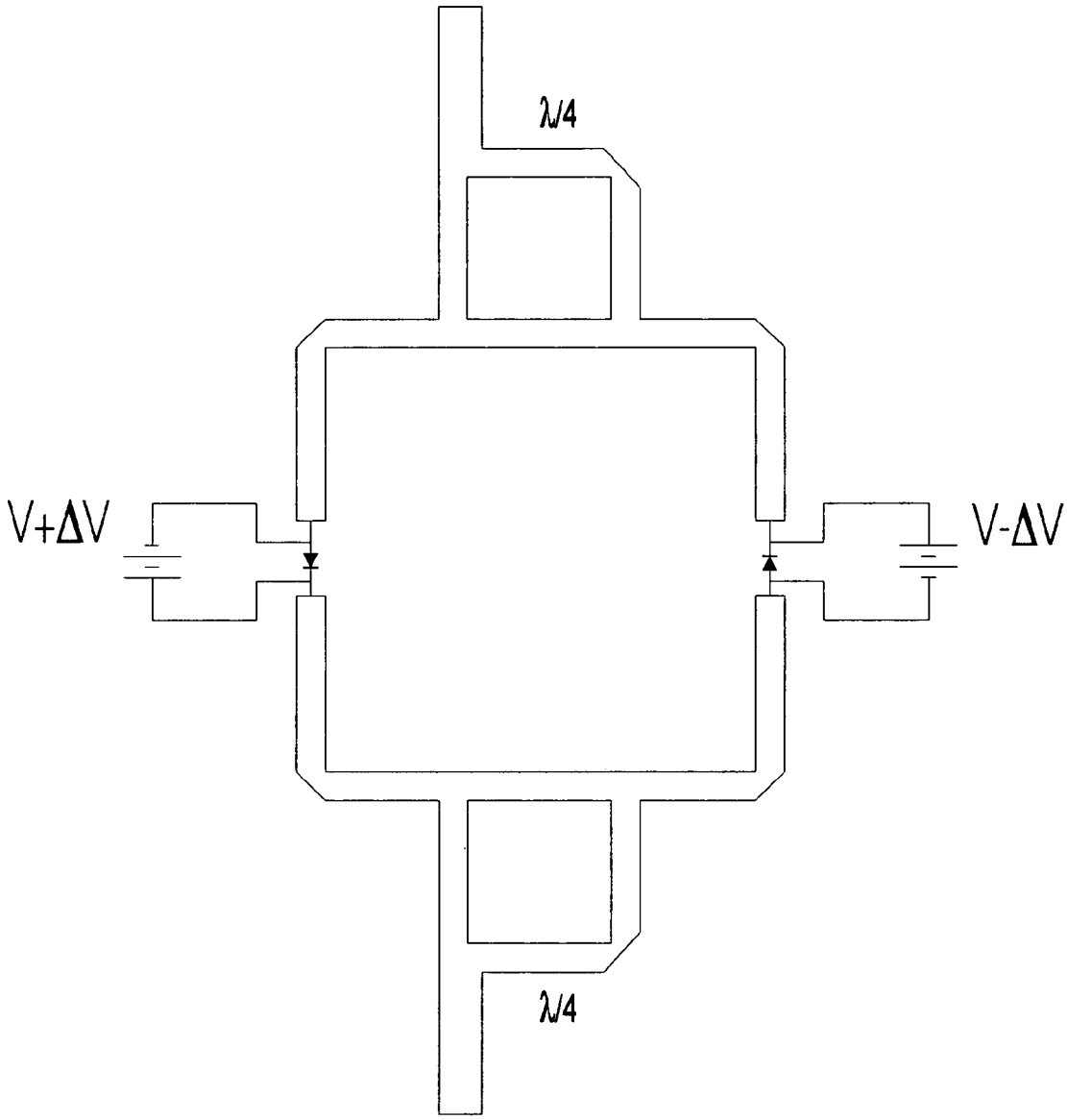

FIG. 9 shows one example of the preferred embodiment of the invention that a nonreciprocal resonator is constructed from a ring resonator loaded with varactor diodes showing symmetry, and the nonreciprocity stems from the employed corporate in-phase feeders, same as FIG. 5, FIG. 6, and FIG. 7. By applying counter-reacting voltages onto the varactor diodes balanced phase shifts result, showing insignificant variation in insertion loss.

DETAILED DESCRIPTION

Prior-Art Explanation:—FIG. 1

FIG. 1 shows the prior art that phase shifts are derived from a linear resonator supporting reciprocal wave propagation. As shown by the middle circuit of FIG. 1 a linear resonator of length L is characterized by the two electronic parameters $\epsilon$ and $\mu$, denoting the capacitance per unit length and inductance per unit length, respectively. If these two parameters are changed via, say, electronic means, the electrical length of the linear resonator will change accordingly, resulting in a shorter or a longer resonance length, corresponding to the increase of $\epsilon$ and $\mu$ to $\epsilon+\Delta\epsilon$ and/or $\mu+\Delta\mu$, shown at left of FIG. 1, and the decrease of $\epsilon$ and $\mu$ to $\epsilon-\Delta\epsilon$ and/or $\mu-\Delta\mu$, shown at right of FIG. 1, respectively. The derived angle in phase shift is $$\Delta\theta=2n\,\Delta L/\lambda, \tag{1}$$

where $\Delta L$ denotes the change in electrical length of the resonator, $\lambda$ is the wavelength, and n is the order of resonance, for example n=0.5 for half-wave resonance, and n=1 for full-wall resonance, etc. However, in accompanying the phase shift operation insertion loss is also changed, since wave propagation will experience different electrical lengths, resulting in different propagation losses, as shown in FIG. 1. As such, the prior-art circuit of FIG. 1 is unbalanced and phase shifts thus obtained shows variations in insertion loss depending on the derived phase-shift angle. Amplifiers are thus needed by the prior art to compensate for the non-uniform operation of the phase-shifter device. The prior art is inconvenient and expensive.

Invention Explanation:—FIG. 2

FIG. 2 explains how balanced phase shifts are obtained from a resonator supporting nonreciprocal wave propagation. In contrast to the prior-art linear resonator supporting reciprocal wave propagation, the resonance modes in a nonreciprocal resonator are non-degenerate allowing for phases to be unambiguously coupled in or out at specific positions (H. How, "Method and Apparatus of Obtaining Phase Shift Using Non-Reciprocal Resonator," Patent Number U.S. Pat. No. 6,483,393, Nov. 19, 2002). As shown at the center of FIG. 2 the resonator is divided in two equal parts showing symmetry which are loaded with electronically active materials characterized by the two electronic parameters $\epsilon$ and $\mu$, denoting the capacitance per unit length and inductance per unit length, respectively. However, if these two electronic parameters are changed in a corporate manner so that one part counter reacts with the other, balanced operation results. This is shown in FIG. 2, the left circuit, that $\epsilon$ and $\mu$ to $\epsilon+\Delta\epsilon$ and/or $\mu+\Delta\mu$ for the left part and to $\epsilon-\Delta\epsilon$ and/or $\mu-\Delta\mu$ for the right part, leaving the overall electrical length of the resonator unchanged. This results no change for the resonance condition, as in contrast to the left circuit of FIG. 1. However, the coupling positions have been effectively changed from an electrical-length point of view, resulting in phase shift of an angle $$\Delta\theta=2n\Delta L/\lambda, \tag{2}$$

where $\Delta L$ denotes the change in electrical length of the resonator in these two respective parts, $\lambda$ is the wavelength, and n is the order of resonance; for example n=1 for the fundamental-mode resonance, and n=2 for the second harmonic resonance, etc. The prior art confirms this assertion, if the resonator supports nonreciprocal wave propagation (H. How, "Method and Apparatus of Obtaining Phase Shift Using Non-Reciprocal Resonator," Patent Number U.S. Pat. No. 6,483,393, Nov. 19, 2002). In other words, upon the change in electronic parameters the overall electrical length of the resonator remains unchanged, but rather the coupling positions of the feeders have been effectively shifted to the right from an electrical-length point of view.

Analogously, the right circuit of FIG. 2 shows the reverse process that $\epsilon$ and $\mu$ change to $\epsilon-\Delta\epsilon$ and/or $\mu-\Delta\mu$ for the right part and to $\epsilon+\Delta\epsilon$ and/or $\mu+\Delta\mu$ for the left part and the overall electrical length of the resonator is unchanged. This causes the coupling positions of the feeders to effectively shift to the left, giving rise to phase shift of an angle $$\Delta\theta=-2n\Delta L/\lambda. \quad (3)$$

Thus, the operation of the phase shifter device shown in FIG. 2 is balanced, and the insertion loss will not vary with the phase-shift operation, to be valid to the first-order approximation, as in contrast to the prior-art circuit of FIG. 1. Amplifiers are no longer needed for the circuit of FIG. 2, because the phase shifter entails uniform operation. The ring geometry assumed by FIG. 2 is not necessary, as demonstrated by another example where a disk geometry is discussed with FIG. 3. The ring resonator of FIG. 2 can be realized incorporating the transmission-line geometries, including microstrip, stripline, waveguide, coax line, parallel wire, coplanar waveguide, image line, fin line, and slot line circuits, rendering convenience and versatility for device applications. The electronic parameter $\epsilon$ and $\mu$ implied by the circuit of FIG. 2 can be changed via electronic means, if the resonator is loaded with electronically active materials, such as ferrites, ferroelectrics, and/or varactors, as to be discussed with the following explicit examples, FIG. 3 to FIG. 9.

Preferred Embodiment:—FIG. 3

FIG. 3 shows one example of the preferred embodiment of the invention that a ferrite disk is biased by a normal magnetic field applied along the axial direction to stimulate nonreciprocal wave propagation. In FIG. 3 the side view is shown at top and the top view is shown at bottom. The circuit shown is FIG. 3 assumes the microstrip geometry and the substrate materials include a ferrite slab to be sandwiched between two dielectric slabs of the same thickness at sides. Ground plane is located under the (ferrite and dielectric) substrate above which the metal circuit is deposited. A permanent magnet is placed under the ground plane to provide a constant global magnetic bias so as to induce nonreciprocity in wave propagation in the ferrite disk region. A pair of balanced magnetic field, called counter reacting fields, is applied onto the two sides of the disk resonator at symmetry, as to be generated from the two coils wound around a common yoke. The magnetic field generated by the permanent magnet is denoted as H and the magnetic field generated by the coil is denoted as $\Delta H$, arising from the feed current $\Delta I$. Thus, the right part of the disk resonator is biased by an effective total field of $H+\Delta H$, and the left part by $H-\Delta H$, causing the permeability value of the disk to change in a manner described with FIG. 2. This results in balanced phase-shift operation, and the variation in insertion loss is thus insignificant. In FIG. 2 the resonator is not necessary to assume the disk geometry; other geometries are also allowed, for example, a patch or a/an regular/irregular ring, so long as they show the left-right symmetry. The microstrip geometry is also not necessary, and the other transmission line geometries equally apply, such as stripline, waveguide, coax line, parallel wire, coplanar waveguide, image line, fin line, and slot line, etc. In FIG. 3 the feeders assume to be coupled to the disk resonator conductively; other feeder coupling mechanisms are also possible, i.e., inductive coupling and capacitive coupling. The permanent magnet placed under the disk resonator can be replaced by an electromagnet. Or even better, hexaferrite (M-type self-biasing) materials can be loaded with the resonator thereby eliminating the need for a common bias utilizing an external magnetic field.

Preferred Embodiment:—FIG. 4

FIG. 4 shows one example of the preferred embodiment of the invention that a nonreciprocal resonator is constructed from a ring resonator loaded with ferrite materials showing symmetry. The ferrites are biased by two kinds of axial fields, supplied by the inner (primary) coils, with feed current I, and the outer (secondary) coils, with feed current $\Delta I$, to provide the common bias and the counter-reacting bias, respectively, as indicated by the current directions feeding into these coils. The common bias removes the degeneracy, causing nonreciprocity in wave propagation, and the counter-reacting bias induces balanced phase shifts, in a manner discussing in association with FIG. 2. Phase shifts thus obtained will show insignificant variation in insertion loss. The transmission-line circuit shown in FIG. 4 can assume microstrip, stripline, waveguide, coax line, parallel wire, coplanar waveguide, image line, fin line, and slot line geometries, etc. In FIG. 4 the feeders adopt capacitive coupling; other feeder coupling mechanisms are also possible, i.e., inductive coupling and conductive coupling. Hexaferrite (Y-type, self-biasing) materials can be used with the circuit thereby eliminating the need for the common bias generated by the primary coils.

Preferred Embodiment:—FIG. 5

FIG. 5 shows one example of the preferred embodiment of the invention that the ferrites shown in FIG. 4 are biased by two individual coils combining the primary and the secondary coils thereby supplying $I+\Delta I$ and $I-\Delta I$ currents onto the respective ferrite loads. Also, in comparison to FIG. 4, the feeding structure has been changed to employ corporate in-phase feeders. Two feeders are said to be corporate in-phase if the two electromagnetic modes, which are propagating along the two opposite directions of the circuit, are in phase at one feeder position for one mode but out of phase at the other feeder position for the other mode, as dictated by the $\lambda/4$ electrical-length specification in FIG. 4. This feeding structure can effectively suppress the out-of-phase mode thereby reinforcing nonreciprocity in wave propagation, as indicated by the arrow direction depicted at the circuit center. FIG. 5 is more appropriate than FIG. 4 for high-order resonance mode applications, n>1 in Eqs. (2) and (3), or if the degree in mode-splitting implied by the ferrite materials is insignificant, for example, when unsaturated ferrites are used. Discussions appearing in association with FIG. 5 can be equally applied with FIG. 4 here.

Preferred Embodiment:—FIG. 6

FIG. 6 shows one example of the preferred embodiment of the invention that a nonreciprocal resonator is constructed from a ring resonator loaded with ferroelectric materials showing symmetry. The required nonreciprocity for wave propagation in the resonator circuit results from the employed corporate in-phase feeders, as discussed in association with FIG. 5. Wave propagation direction is shown by the arrow direction depicted at the center of the circuit. The common bias voltage V is needed to properly locate the operation point. Balanced phase shifts are induced from applying counter-reacting voltages ΔV onto the ferroelectric materials, and the insertion loss shows insignificant variation with the phase shift angles, as discussed previously. The transmission-line circuit shown in FIG. 6 can assume microstrip, stripline, waveguide, coax line, parallel wire, coplanar waveguide, image line, fin line, and slot line geometries, etc. In FIG. 6 the feeders adopts capacitive coupling; other feeder coupling mechanisms are also possible, i.e., inductive coupling and conductive coupling.

Preferred Embodiment:—FIG. 7

FIG. 7 shows one example of the preferred embodiment of the invention that a nonreciprocal resonator is constructed from a ring resonator loaded with both ferrite and ferroelectric materials showing symmetry. The required nonreciprocity for wave propagation in the resonator circuit results from the employed corporate in-phase feeders, as discussed in association with FIG. 5. Common bias current I, feeding into the inner primary coils, and common bias voltage V are required to properly locate the operation point of the ferrite and the ferroelectric materials, respectively. Balanced phase shifts are induced from applying counter-reacting currents ΔI, feeding into the secondary outer coils, and voltages ΔV onto the ferrite and the ferroelectric materials, and the insertion loss shows insignificant variation with the phase shift angles, as discussed previously. The transmission-line circuit shown in FIG. 7 can assume microstrip, stripline, waveguide, coax line, parallel wire, coplanar waveguide, image line, fin line, and slot line geometries, etc. In FIG. 6 the feeders adopts capacitive coupling; other feeder coupling mechanisms are also possible, i.e., inductive coupling and conductive coupling. Hexaferrite (Y-type, self-biasing) materials can be used with the circuit thereby eliminating or reducing the need for the common bias current I feeding into the primary coils.

Preferred Embodiment:—FIG. 8

FIG. 8 shows one example of the preferred embodiment of the invention that a nonreciprocal resonator is constructed from a ring resonator loaded with both ferrite and ferroelectric materials showing symmetry, and the nonreciprocity results from the ferrite materials, same as FIG. 4. Common bias current I and common bias voltage V are required to properly locate the operation point of the ferrite and the ferroelectric materials, respectively. Balanced phase shifts are induced from applying counter-reacting currents ΔI and voltages ΔV onto the ferrite and the ferroelectric materials, and the insertion loss shows insignificant variation with the phase shift angles, as discussed previously. The transmission-line circuit shown in FIG. 8 can assume microstrip, stripline, waveguide, coax line, parallel wire, coplanar waveguide, image line, fin line, and slot line geometries, etc. In FIG. 8 the feeders adopt capacitive coupling; other feeder coupling mechanisms are also possible, i.e., inductive coupling and conductive coupling. Hexaferrite (Y-type, self-biasing) materials can be used with the circuit thereby eliminating or reducing the need for the common bias current I feeding into the bias coils.

Preferred Embodiment:—FIG. 9

FIG. 9 shows one example of the preferred embodiment of the invention that a nonreciprocal resonator is constructed from a ring resonator loaded with varactor diodes showing symmetry, and the required nonreciprocity for wave propagation in the resonator circuit results from the employed corporate in-phase feeders, as discussed in association with FIG. 5. Common bias voltage V is required to properly locate the operation point of the varactor diodes. Balanced phase shifts are induced from applying counter-reacting voltage ΔV superimposed with the common bias voltage V, i.e., V±ΔV, resulting in insignificant variation in insertion loss with the phase shift angles, as discussed previously. The transmission-line circuit shown in FIG. 7 can assume microstrip, stripline, waveguide, coax line, parallel wire, coplanar waveguide, image line, fin line, and slot line geometries, etc. In FIG. 6 the feeders adopt conductive coupling; other feeder coupling mechanisms are also possible, i.e., inductive coupling and capacitive coupling. In FIG. 9 the loaded electronically active materials assume the for form of varactor diodes. Other electronic forms are also possible, for example, semiconductor transistors operational in the reverse biased depletion mode.

CONCLUSIONS

A resonator, which supports nonreciprocal wave propagation and contains electronically active materials, can be used in a counter-reacting manner so as to induce a phase shifts result but not to alter the overall resonance condition. This implies the phase shift operation is uniform, and the insertion loss will show much dependence on the derived phase-shift angles. As such, the need for amplifiers is eliminated, resulting in cost saving. The phase shifter can operate via electrical means, magnetical means, or both, incorporating ferroelectric, ferrite, and semiconductor junction materials. The invented phase shifter apparatus can be fabricated assuming the planar geometries, or the waveguide/coax/parallel-line geometries, thereby furnishing versatility in applications, to be adapted with phased array systems, T/R modules, and with power circuits.

I claim:

1. A balanced phase shifter device, comprising

A) a resonator supporting nonreciprocal wave propagation which can be divided in two parts showing symmetry and is loaded with electronically active material or materials, B) electronic means to bias said resonator with respect to said electronically active material or materials in a manner counter-reacting each other for said two parts of said resonator causing insignificant change in the overall resonance condition, wherein, said electronic means induce effectively shift in the coupling positions of feeders in reference to said resonator in the electrical sense, resulting in phase shift of the transmitted signal or waveform from said resonator whose amplitude depends insignificantly on the derived angle in said phase shift thereby realizing the balanced phase shift operation.

2. The balanced phase shifter device of claim 1 wherein said electronically active material or materials include cubic/hexagonal ferrite or ferrites, ferroelectrics, semiconductor junctions such as diodes or transistors, or in combination.

3. The balanced phase shifter device of claim 1 wherein said electronic means include the application of bias voltages, bias currents, bias electric fields, and/or bias magnetic field or fields.

4. The balanced phase shifter device of claim 1 wherein said resonator assumes the geometry of microstrip, stripline, coplanar waveguide, slotline, finline, image line, waveguide, coax line, parallel wire, or in combination, including coupled transmission lines.

5. The balanced phase shifter device of claim 1 wherein said feeders couple to said resonator via the mechanism of conductive coupling, inductive coupling, capacitive coupling, or in combination.

6. The balanced phase shifter device of claim 1 wherein said resonator assumes the shape of a disk or a ring not necessarily to show the circular symmetry.

7. The balanced phase shifter device of claim 1 wherein said nonreciprocal wave propagation results from said electronically active material or materials, the corporate in-phase feeding configuration adopted by said feeders, or in combination.

8. A method of obtaining balanced phase shift operation, comprising

A) employing a resonator supporting nonreciprocal wave propagation which can be divided in two parts showing symmetry and is loaded with electronically active material or materials, B) applying electronic means to bias said resonator with respect to said electronically active material or materials in a manner counter-reacting each other for said two parts of said resonator causing insignificant change in the overall resonance condition, wherein said electronic means induce effectively shift in the coupling positions of feeders in reference to said resonator in the electrical sense, resulting in phase shift of the transmitted signal or waveform from said resonator whose amplitude depends insignificantly on the derived angle in said phase shift thereby realizing said balanced phase shift operation.

* * * * *